US006891095B2

(12) United States Patent
Charters

(10) Patent No.: US 6,891,095 B2
(45) Date of Patent: May 10, 2005

(54) MULTI-PICK APPARATUS FOR A STRINGED INSTRUMENT

(76) Inventor: William J. Charters, P.O. Box 62, Danville, NH (US) 03819

( * ) Notice: Subject to any disclaimer, the term of this patent is extended or adjusted under 35 U.S.C. 154(b) by 61 days.

(21) Appl. No.: 10/404,363

(22) Filed: Mar. 31, 2003

(65) Prior Publication Data

US 2004/0187668 A1 Sep. 30, 2004

(51) Int. Cl.[7] ..... G10D 3/16

(52) U.S. Cl. ..... 84/320; 84/321; 84/322; 84/329; D17/20

(58) Field of Search ..... 84/320, 321, 322, 84/329; D17/20

(56) References Cited

U.S. PATENT DOCUMENTS

| | | | | | |
|---|---|---|---|---|---|
| 567,447 | A | | 9/1896 | Barrientos | 84/291 |
| 768,241 | A | | 8/1904 | Seidel | 84/322 |
| 3,304,826 | A | | 2/1967 | Caros | 84/322 |
| 3,312,137 | A | | 4/1967 | Oddo | 84/322 |
| 3,678,793 | A | * | 7/1972 | Schutze | 84/258 |
| D257,151 | S | | 9/1980 | Burke | D17/20 |
| 4,248,128 | A | | 2/1981 | Des Gaines | 84/322 |
| 5,253,562 | A | | 10/1993 | Kline | 84/322 |
| D369,615 | S | | 5/1996 | Latteri | D17/20 |
| 5,594,189 | A | | 1/1997 | Latteri | 84/322 |
| 6,133,516 | A | * | 10/2000 | Hendrickson | 84/322 |
| D444,167 | S | | 6/2001 | Charters | D17/20 |

* cited by examiner

*Primary Examiner*—Shih-Yung Hsieh
(74) *Attorney, Agent, or Firm*—Pearson & Pearson, LLP

(57) ABSTRACT

A rhythm multi-pick apparatus comprising a member holder having a plurality of spaced-apart pick members, a first lift end having a curved shape attached on a first end of the member holder, a second lift end having a curved shape attached on a second end of the member holder, and a holder arm attached between the first lift end and the second lift end. A handle having grooves for two fingers is attached to the holder arm opposite the member holder. The pick members are cylindrical shape and may be made from different materials resulting in ratings of soft, medium, and hard for producing different tones. The multi-pick apparatus may have various embodiments, each embodiment having a different number of pick members held by the member holder. Another embodiment comprises the multi-pick apparatus without a handle which is held by a user by gripping a continuous holder arm.

12 Claims, 7 Drawing Sheets

MULTI-PICK APPARATUS FOR A STRINGED INSTRUMENT

BACKGROUND OF THE INVENTION

1. Field of the Invention

This invention is directed to a rhythm multi-pick used to enhance and richen the sounds and tone of a stringed instrument, and in particular to a rhythm multi-pick comprising a plurality of spaced-apart pick members and having a handle for comfortably resting the fingers of a hand of an instrumentalist when playing the stringed instrument.

2. Description of Related Art

Stringed instruments such as guitars, mandolins and banjos, are activated by picking the strings. A pick is used to engage the strings and produce musical tones of the instrument. Single picks strike only one string at a time, working the pick in a singular manner, one note at a time. No matter how fast the single pick strikes the strings, it can only achieve one note at a time. To produce chords a single pick is rapidly moved sequentially across all the strings and each of the strings vibrate producing a musical tone depending on the tension and length of the strings.

Single picks are limited to one single pick, and multi-picks are not limited to a single pick. Multi-picks can have few or many picks or members. Single picks work in a single manner. Multi-picks work in a plural manner. A single pick cannot eliminate a multi-pick. A multi-pick can eliminate a single pick in a limited way. Multi-picks give the instrumentalist new techniques; new style, new sounds.

A multi-pick structure has been used to simultaneously strike two or three strings of a musical instrument and not necessarily adjacent strings. Previous multi-picks have a rectangle shape with four flat surfaces. The surface of the rectangle that faces the strings sometimes comes in contact with the strings and makes a screeching, shrill noise drowning out the music you really want to hear. For example, U.S. Pat. No. 3,304,826, issued Feb. 21, 1967 to C. Caron, discloses a multi-pick structure wherein each of the pick elements comprises a spacer and a pick which may be stacked to form different multi-pick arrangements. The distance between the picks is substantially equal to the spacing between the strings of the instrument on which the multi-pick assembly is to be used. The flat shape picks in U.S. Pat. No. 3,304,826 do not sound or work well in a multi-pick. Flat picks shaped like a triangle and other flat shapes have lots of flat surfaces causing a slapping noise when a multi-pick is strummed over the strings of a stringed instrument. A slapping noise, caused by the flat surface of the picks slapping the strings, overcomes and drowns out the music a listener wants to hear.

Other pick devices for stringed instruments are known and described in the following U.S. patents:

U.S. Pat. No. 567,447, issued Sep. 8, 1896 to F. Barrientos, Discloses a musical instrument with a double pick which comprises a bar having two spaced-apart teeth extending therefrom. This device can only work in a singular way. It is not a multi-pick. Further, U.S. Pat. No. 768,241, issued Aug. 23, 1904, to Charles F. W. Seidel, discloses a pick having three picking points. This type of pick comprises lots of surface area and produces noise.

U.S. Pat. No. 4,248,128, issued Feb. 3, 1981, to Laurence Des Gaines, discloses a tapered array of a plurality of parallel guitar picks which are closely knitted together and mounted in a handle. Although it is a multi-pick, the spacing of the picks is not far enough apart to be in a class of rhythm multi-picks, where equal regularly alternating beats are played. Therefore, it is used in a single pick manner.

U.S. Pat. No. 5,594,189, issued Jan. 14, 1997, to Keith Latteri, discloses a tripoint plectrum having a body from which three equally spaced, parallel arranged pick members extend. The central pick member extends further from the body than do the outer two pick members. The one piece construction permits the central pick and one of the other outer picks to displace an instrument string on both the downstroke and upstroke while reducing unwanted vibration and resonance. However, strings vibrate slightly longer like in U.S. Pat. No. 4,248,128 and rhythm or equal regular alternating beats are not produced.

U.S. Des. Pat. No. D444,167, issued Jun. 26, 2001 to William J. Charters, discloses a quasi-rectangular shaped multi-pick apparatus having tapered ends to reduce unwanted noises if the body of the multi-pick comes in contact with the strings of an instrument.

SUMMARY OF THE INVENTION

Accordingly, it is therefore an object of this invention to provide a multi-pick apparatus having a plurality of pick members for use with a stringed instrument to provide various chord sounds, techniques and styles of music.

It is a further object of this invention to provide a multi-pick apparatus having a curved member holder and a handle with finger grooves positioned opposite said member holder to accommodate the fingers and movement of a person's hand while playing a stringed musical instrument.

It is another object of this invention to provide various types of members such as soft, medium and hard to produce different tones.

These and other objects are further accomplished by a member holder comprising an elongated element having a plurality of spaced-apart holes, and a pick member inserted and retained in each of the spaced-apart holes and extending a predetermined distance away from the elongated element. The elongated element comprises a curvature having a radius of approximately 16 inches. The holes for receiving each of the pick members are positioned approximately perpendicular to a plane of the member holder. The pick members comprise one of a Teflon® material, nylon material, monofilament, or a rubber based material. The member holder further comprises a first lift end attached to a first end of the member holder and a second lift end attached to a second end of the member holder.

The objects are further accomplished by a multi-pick apparatus comprising a member holder, the member holder comprises a plurality of flexible, spaced-apart pick members extending from the member holder, and means attached to the member holder for enabling a user to grip the multi-pick apparatus. The member holder comprises a first end lift on a first end of the member holder and a second end lift on a second end of the member holder. The enabling means comprises a handle, a holder arm having a first end attached to the first end lift and a second end attached to the second end lift, the handle attached in the center of the holder arm opposite the member holder. The plurality of flexible, spaced-apart pick members are spaced-apart a distance equal to the distance between every other string on an instrument on which the multi-pick apparatus is used. The handle comprises at least one groove for a user's finger, the groove being located at one end of the handle opposite the member holder.

The objects are further accomplished by a method of providing a multi-pick comprising the steps of providing a plurality of flexible pick members on a member holder, spacing apart each of the plurality of flexible pick members according to a spacing between strings of a predetermined stringed instrument, and attaching a handle to a holder arm, the holder arm being attached to each end of the member holder. The step of attaching a handle comprises the step of providing grooves in an end of the handle closest to the member holder for a user's fingers to rest. The method comprises the steps of inserting a first lift end between a first end of the member holder and a first end of the holder arm, and inserting a second lift end between a second end of the member holder and a second end of the holder arm. The step of providing a plurality of flexible pick members on a member holder comprises the step of selecting one of a Teflon® material, nylon material or monofilament material for the pick members.

Additional objects, features and advantages of the invention will become apparent to those skilled in the art upon consideration of the following detailed description of the preferred embodiments exemplifying the best made of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
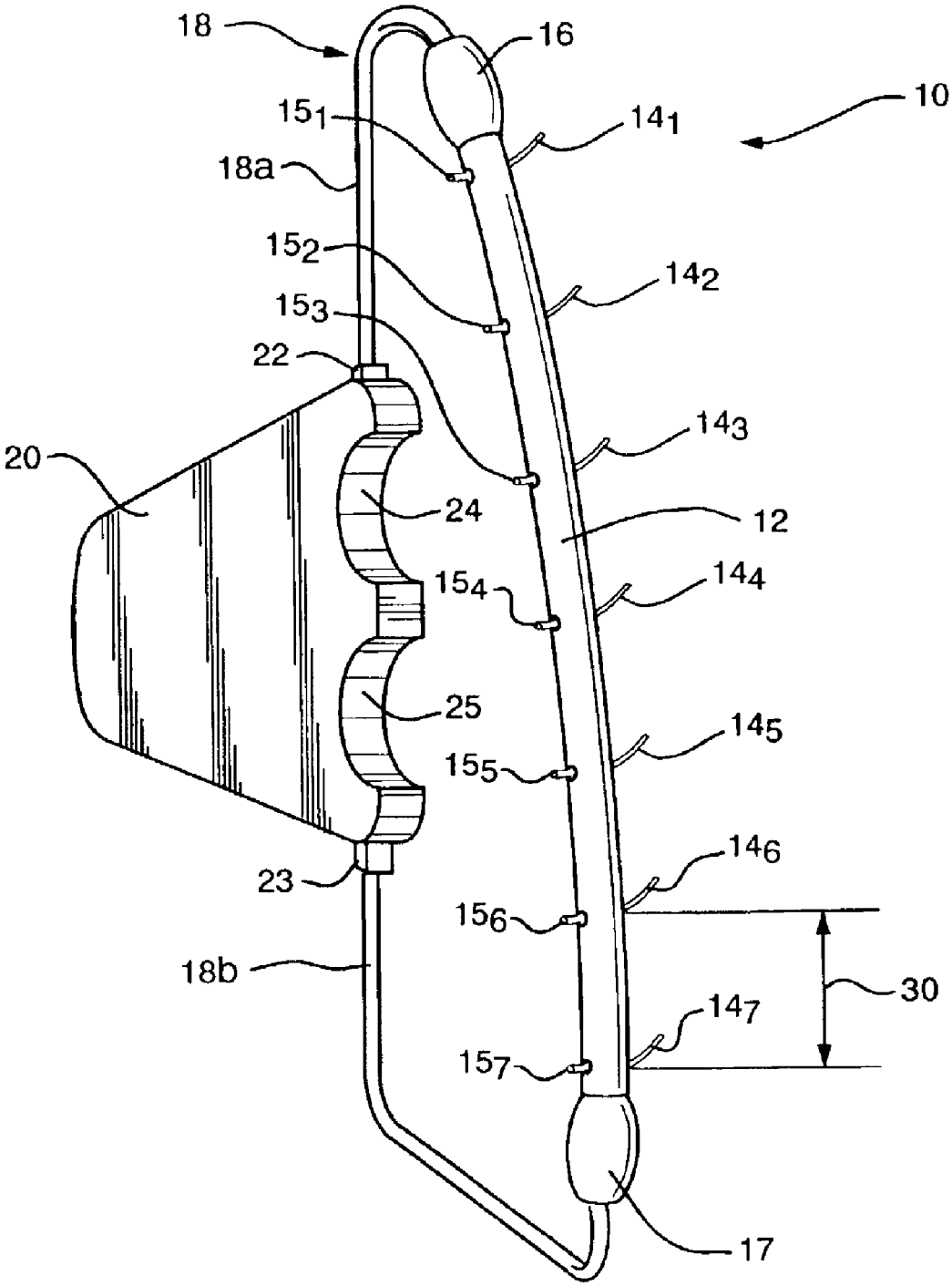
FIG. 1 is a front perspective view of a multi-pick in accordance with the present invention.
Figure 2:
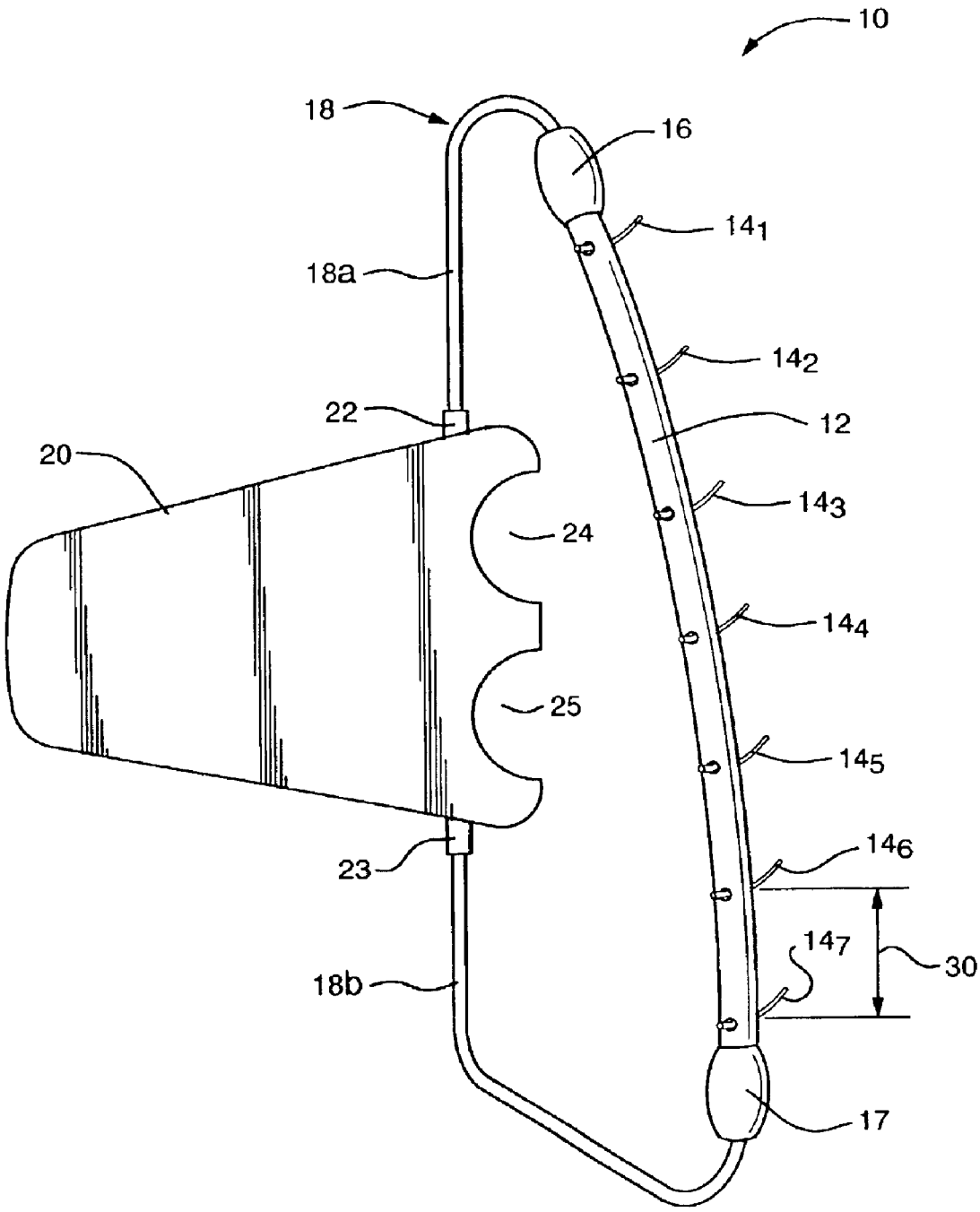
FIG. 2 is a front elevational view of the multi-pick according to the present invention.

Referring to FIG. 1 and FIG. 2, FIG. 1 is a front perspective view of a rhythm multi-pick 10 according to the present invention, and FIG. 2 is a front elevational view of the multi-pick 10. The rhythm multi-pick 10 is used to pick two or three strings simultaneously of a musical instrument, and it comprises a member holder 12 having a plurality of spaced-apart pick members $\mathbf{14}_1$–$\mathbf{14}_7$, a first lift end 16 having an oval-shape attached on a first end of the member holder 12 and a second lift end 17 having an oval shape attached on a second end of the member holder 12. The lift ends 16, 17 are curved or oval-shaped to push an E-string over the member holder 12 of the multi-pick 10 when it is used with a musical instrument. A holder arm 18 comprises a first end portion 18*a* and a second end portion 18*b*, and a handle 20 is attached between the first end portion 18*a* and the second end portion 18*b*. The handle 20 may be attached to the holder arm 18 by compression fittings of a shaft through a sleeve, or by splitting the handle 20 in half and compressing the halves around the holder arm 18. The holder arm 18 may be embodied with a one-eighth inch brass rod which is commonly available or other materials such as stainless steel, aluminum or plastics may be used. The handle 20 is tapered starting at the holder arm 18 and extending away from the holder arm 18. The handle 20 may be embodied by wood or plastic materials commonly known in the art. The first end portion 18a has a curve near its end of approximately 170° where it attaches to the first lift end 16. The second end portion 18*b* has an approximate 80° turn and then extends a distance just under the end of the second lift end 17 where it turns upward with approximately a 90° radius and attaches to the second lift end 17. The end of the handle 20 immediately opposite the member holder 12 comprises two grooves for a stringed instrument player to rest two fingers, as shown in FIGS. 1 and 2. However, a handle with one groove or without grooves is also applicable.

The member holder 12 is curved with a radius of approximately 16 inches, it is cylindrical or tubular-shaped and not rectangular in order to reduce surface area in order to reduce the probability of the member holder 12 hitting the strings. The spaced-apart members $\mathbf{14}_1$–$\mathbf{14}_7$ may be made of Teflon®, nylon, monofilament, and other similar materials for producing various tones from a stringed instrument. A synthetic rubber 19 such as a neoprene or a synthetic rubber made by polymerizing butadiene is placed inside the member holder 12 to hold the members $\mathbf{14}_1$–$\mathbf{14}_7$ in place. The members $\mathbf{14}_1$–$\mathbf{14}_7$ are inserted into spaced-apart holes $\mathbf{15}_1$–$\mathbf{15}_7$ of the member holder 12 and protrude to a length of about three-sixteenth inch to one-quarter inch. The holes $\mathbf{15}_1$–$\mathbf{15}_7$ have a diameter of one-thirty second inch or smaller, and are perpendicular to the surface of member holder 12. The member holder 12 is covered with a clear plastic tubing 13 which may be embodied by commonly available fish tank tubing. When the members $\mathbf{14}_1$–$\mathbf{14}_7$ begin to wear, each member can be pulled further through the holes $\mathbf{15}_1$–$\mathbf{15}_7$ because of the extra length extending on the opposite side of the members $\mathbf{14}_1$–$\mathbf{14}_7$. The members $\mathbf{14}_1$–$\mathbf{14}_7$ may be embodied by Item No. IFB 05000 (0.050 PTFE beading natural) manufactured by Atlantic Tubing Company of Chestnut Ridge, N.Y. 10977.

An array of multi-picks 10 may be implemented and rated as soft, medium and hard depending on the material used to make the pick members 14. The space 30 between two adjacent pick members 14 is determined by the distance between adjacent strings on the instrument on which the multi-pick is intended to be used. Therefore, there are many variations for the spacing of the pick members $\mathbf{14}_1$–$\mathbf{14}_7$ on the member holder 12, and the spacing in the figures is exemplary of many different embodiments.

Figure 3:
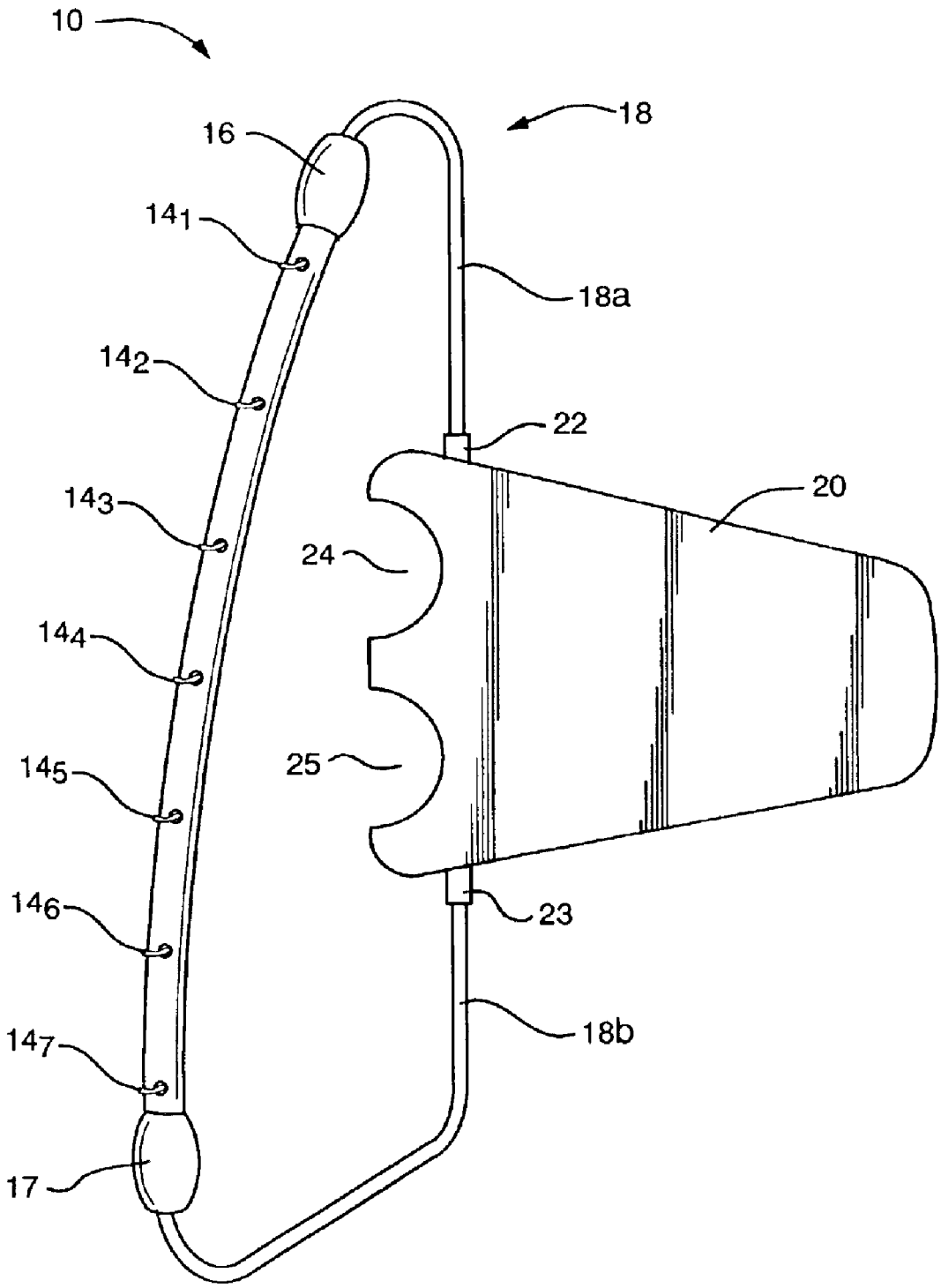
FIG. 3 is a rear elevational view of the multi-pick.
Figure 4:
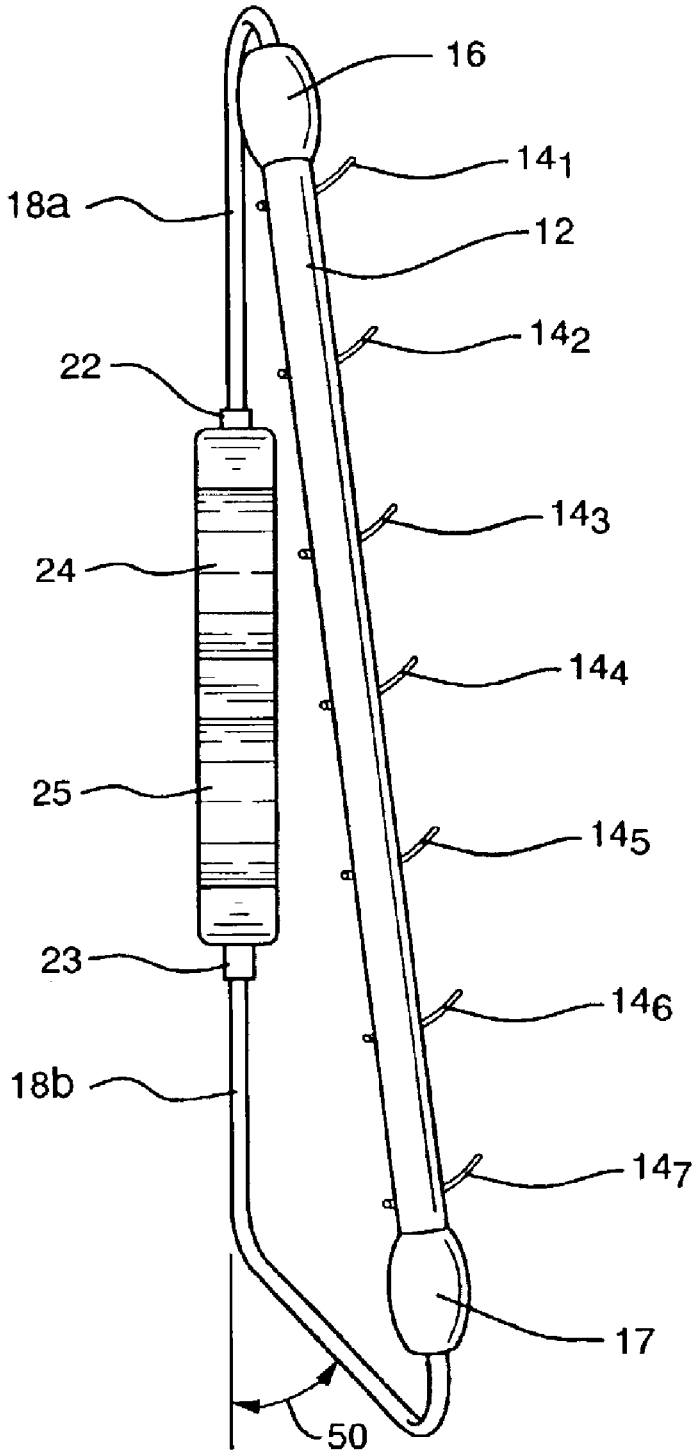
FIG. 4 is a right side elevational view of the multi-pick.

Referring to FIG. 3 and FIG. 4, FIG. 3 is a rear elevational view of the multi-pick 10 and FIG. 4 is a right side elevational view of the multi-pick 10. An offset angle 50 of approximately forth-five degrees measured between the plane of the handle 20 and the holder arm second end portion 18*b* is shown in FIG. 4 which makes the multi-pick 10 more comfortable for a user when producing the sounds of chords by moving the multi-pick 10 across the strings. The offset angle 50 may vary depending on the length of the member holder 12.

Figure 5:
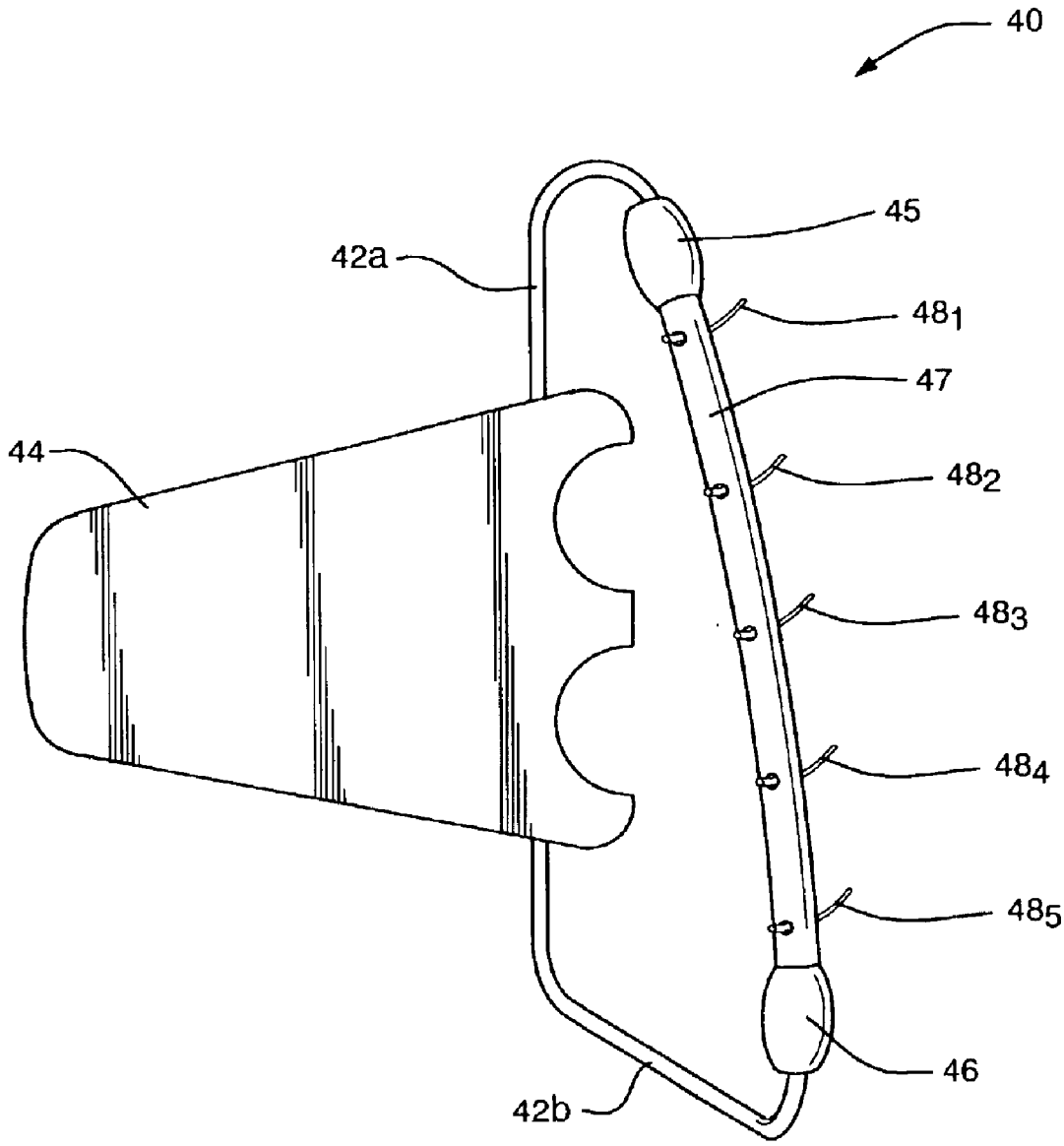
FIG. 5 is a front elevational view of a first alternate embodiment of a multi-pick.

Referring now to FIG. 5, a front elevational view of a first alternate embodiment of a multi-pick 40 is shown comprising a shorter member holder 47 and a reduced number of members $\mathbf{48}_1$–$\mathbf{48}_5$ compared to the multi-pick 10. There are various other size multi-picks that may be implemented depending on a user's preference or requirements for playing a stringed instrument. Multi-pick 40 comprises a handle 44 and holder arm 42*a*, 42*b*, for securing the member holder 47 to the handle 44 via the lift ends 45, 46 respectively, on each end of the member holder 47.

Figure 6:
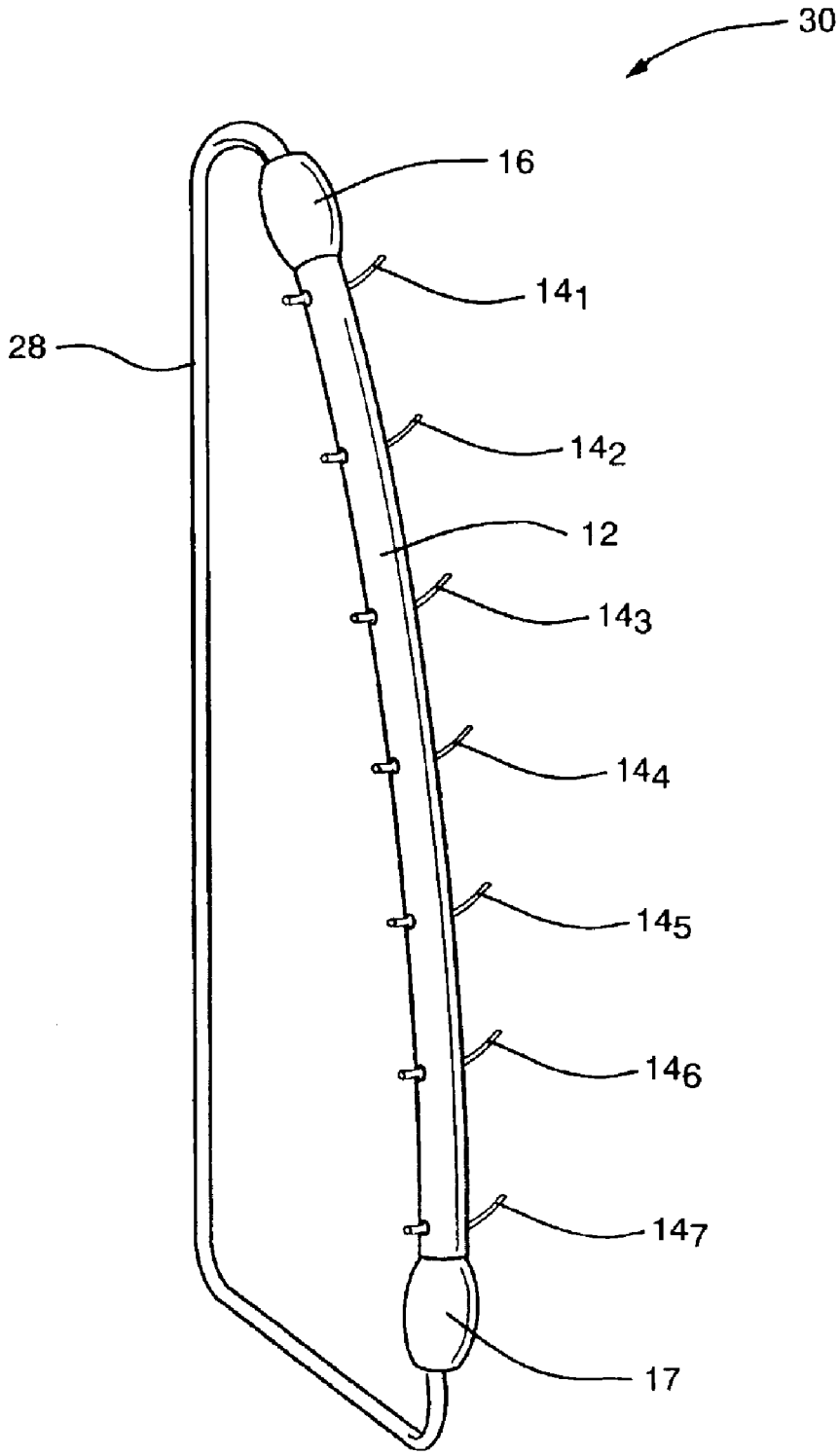
FIG. 6 is a front perspective view of a second alternate embodiment of a multi-pick.

Referring to FIG. 6, a front perspective view of a second alternate embodiment of a multi-pick 30 is shown comprising a member holder 12 having a plurality of members $\mathbf{14}_1$–$\mathbf{14}_7$. A first lift end 16 is attached to a first end of member holder 12 and a second lift end 17 is attached to the second end of member holder 12. A top portion of holder arm 28 attaches to the first lift end 16 and a lower portion of the holder arm 28 attaches to the second lift end 17. The holder arm 28 and the member holder 12 are located in the same plane.

Figure 7:
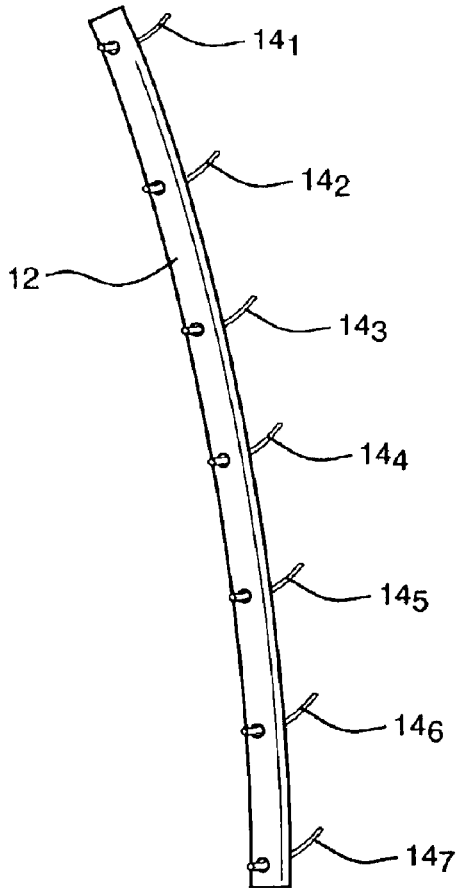
FIG. 7 is a front elevational view of a curved member holder according to the invention.
Figure 8:
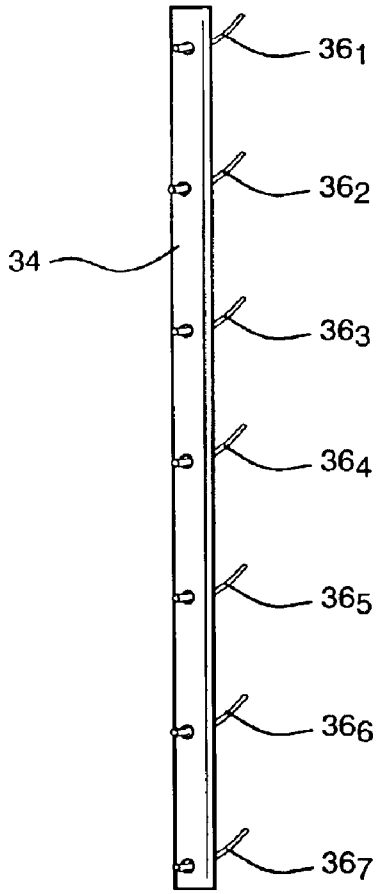
FIG. 8 is a front elevational view of a straight member holder according to the invention.

Referring now to FIG. 7 and FIG. 8, FIG. 7 is a front elevational view of curved and tube-shaped member holder 12 of FIG. 1 and FIG. 2 comprising a plurality of members $\mathbf{14}_1$–$\mathbf{14}_7$. FIG. 8 shows a straight member holder 34 comprising a plurality of members $\mathbf{36}_1$–$\mathbf{36}_7$. The tube shape member holder 12 comprises a side of the tube that faces the strings and includes a lesser amount of surface than the rectangle member holder 34 embodiment in FIG. 8. When the strings of an instrument come in contact with the lesser amount of surface that is on the tube member holder 12 embodiment, screeching is at a low and not noticeable level.

Figure 9:
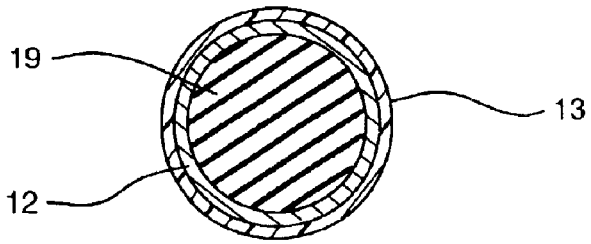
FIG. 9 is a top view of the curved member holder of FIG. 7 showing an outside plastic tubing and an inside synthetic rubber for holding pick members in place.

Referring to FIG. 9, a top view of the member holder 12 of FIG. 7 is shown which comprises a hollow cylindrical tube surrounded by the plastic tubing 13. The synthetic rubber 19 is provided within the member holder 12 for securing each member $\mathbf{14}_1$–$\mathbf{14}_7$ when inserted therethrough. The hollow cylindrical tube may be embodied by brass tubing such as round brass tube 0.014 wall. size, 5/32 or 1/8, manufactured by K&S Engineering, of Chicago, Ill. 60638.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A member holder comprising:

an elongated element having a plurality of spaced-apart holes;

a pick member inserted and retained in each of said spaced-apart holes and extending a predetermined distance away from said elongated element; and said member holder further comprises a first lift end attached to a first end of said member holder and a second lift end attached to a second end of said member holder.

2. The member holder as recited in claim 1 wherein said elongated element comprises a curvature having a radius of approximately 16 inches.

3. The member holder as recited in claim 1 wherein said holes for receiving each of said pick members are positioned approximately perpendicular to a plane of said member holder.

4. The member holder as recited in claim 1 wherein said pick members comprise one of a Teflon® material, nylon material, monofilament, or a rubber based material.

5. A multi-pick apparatus comprising:

a member holder, said member holder comprises a plurality of flexible, spaced-apart pick members extending from said member holder;

means attached to said member holder for enabling a user to grip said multi-pick apparatus; and said member holder comprises a first lift end on a first end of said member holder and a second lift end on a second end of said member holder.

6. The multi-pick apparatus as recited in claim 5 wherein said enabling means comprises:

a handle;

a holder arm having a first end attached to said first lift end and a second end attached to said second lift end, said handle attached in the center of said holder arm opposite said member holder.

7. The multi-pick apparatus as recited in claim 6 wherein said handle comprises at least one groove for a user's finger, said groove being located at one end of said handle opposite said member holder.

8. The multi-pick apparatus as recited in claim 5 wherein said plurality of flexible, spaced-apart pick members are spaced-apart a distance equal to the distance between every other string on an instrument on which said multi-pick apparatus is used.

9. A method of providing a multi-pick comprising the steps of:

providing a plurality of flexible pick members on a member holder;

spacing apart each of said plurality of flexible pick members according to a spacing between strings of a predetermined stringed instrument; and attaching a handle to a holder arm, said holder arm being attached to each end of said member holder.

10. The method as recited in claim 9 wherein said step of attaching a handle comprises the step of providing grooves in an end of said handle closest to said member holder for a user's fingers to rest.

11. The method as recited in claim 9 wherein said method comprises the steps of:

inserting a first lift end between a first end of said member holder and a first end of said holder arm; and inserting a second lift end between a second end of said member holder and a second end of said holder arm.

12. The method as recited in claim 9 wherein said step of providing a plurality of flexible pick members on a member holder comprises the step of selecting one of a Teflon® material, nylon material or monofilament material for said pick members.

* * * * *